United States Patent [19]

Lau

[11] 4,215,943

[45] Aug. 5, 1980

[54] MOTOR DRIVEN SINGLE ELEMENT PRINTER

[75] Inventor: Edward H. Lau, Old Westbury, N.Y.

[73] Assignee: Redactron Corporation, Hauppauge, N.Y.

[21] Appl. No.: 917,554

[22] Filed: Jun. 21, 1978

Related U.S. Application Data

[63] Continuation-in-part of Ser. No. 650,414, Jan. 19, 1976, which is a continuation of Ser. No. 492,692, Jul. 29, 1974, abandoned.

[51] Int. Cl.[2] ..... B41J 1/60

[52] U.S. Cl. ..... 400/161.1; 400/162.3; 400/163; 400/166

[58] Field of Search ..... 400/160, 161, 161.1–161.5, 400/162.2, 162.3, 163, 166

[56] References Cited

U.S. PATENT DOCUMENTS

| | | | |
|---|---|---|---|
| 3,014,569 | 12/1961 | Palmer | 400/161.1 X |
| 3,628,644 | 12/1971 | Cralle et al. | 400/166 |
| 3,695,410 | 10/1972 | Kapp | 400/166 X |
| 3,788,443 | 1/1974 | Menzi | 400/166 |
| 3,789,971 | 2/1974 | Deyessa et al. | 400/162.2 X |
| 3,924,721 | 12/1975 | Reynolds | 400/162.2 |

*Primary Examiner*—Paul T. Sewell

*Attorney, Agent, or Firm*—Hane, Roberts, Spiecens & Cohen

[57] ABSTRACT

A printer has a horizontally movable carrier which supports a print head including a print element on which are disposed type characters in a two dimensional array with the element controllably movable by motors in two degrees of freedom to selectively position each type character opposite a record-medium-carrying platen for printing. The print head is on a rocker having a cam follower which cooperates with a cam on a shaft driven by a variable speed motor which is also on the carrier. During printing the motor speed is controlled so that the print element is driven against the platen with a force related to the particular character being printed. The motor speed is further controlled so that there is not only a minimum wait between the printing of successive characters but there are also minimum accelerations and decelerations of the motor.

2 Claims, 9 Drawing Figures

SHAFT VELOCITY AS FUNCTION OF TIME

PRINT CONTROL PC 7
8
30
40
40C
40B
16
40A
74
72
102
32
66
20
22
62
58
46,48
26
18
64
60
24
42
70
28
26
34
68
44
22
26
7

40
82
40B
74A
40C
30
76
96B
104
108
40A
96
72
98
116
74
66
102
96A
120
58
92
86
64
62
18
86A
84A
90
24
84
88
80
28
26
26
26
26

62
94
114
40
96
74
40B
102
98
116
104
92
86A
90
86
18
84A
84
80
64
66
58

MOTOR DRIVEN SINGLE ELEMENT PRINTER

CROSS-REFERENCE TO RELATED APPLICATIONS

This application is a continuation-in-part of application Ser. No. 650,414, filed Jan. 19, 1976 and which is a continuation of application Ser. No. 492,692 filed July 29, 1974 and now abandoned.

BACKGROUND OF THE INVENTION

This invention pertains to printers and more particularly to single element printers which are motor driven.

Of the many uses for printers there are two which predominate in number. They are keyboard controlled typewriters and signal controlled output devices for computers, communications terminals and the like. In fact, many such output devices utilize conventional electric typewriters. Of the conventional electric typewriters the single-element print head variety as exemplified by the IBM Selectric family have become the most popular. While such typewriters are adequate for many tasks, it should be realized they are highly complex machines containing innumerable mechanical drives, linkages and the like. This complexity results in an initially expensive machine. In addition, while a typewriter is satisfactory for use by a typist, it not only has a too low upper limit of speed when driven by a computer or the like, but also is not sufficiently rugged for the extended periods of continued use required in many computer, word processing and communications applications. Furthermore, such machines are noisy. These limitations arise from the mechanical complexity of presently available typewriters.

SUMMARY OF THE INVENTION

It is, accordingly, a general object of the invention to provide an improved printer.

It is another object of the invention to provide an improved printer wherein coded combinations of signals represent the characters to be printed and these coded combinations of signals are processed to select the type characters for printing.

It is a further object of the invention to provide an improved single element print head printer.

Briefly, the invention contemplates a print head opposite a platen. The print head includes a print element bearing type characters which are selected by a positioning means. The print element is supported on a rocker means which carries a cam follower and is pivotably mounted so that the print element can impact the platen. A drive shaft with a cam which cooperates with the cam follower is driven by a drive means for unidirectionally rotating the shaft during each cycle at two different speeds, one speed being related to the actual character being printed and the other speed being related to the time required for the print head and element to be in the desired position for printing.

BRIEF DESCRIPTION OF THE DRAWINGS

Other objects, the features and advantages of the invention will be apparent from the following detailed description when read with the accompanying drawing which shows by way of example, and not limitation, an exemplary embodiment of the invention.

In the drawing.

DETAILED DESCRIPTION

Figure 1:
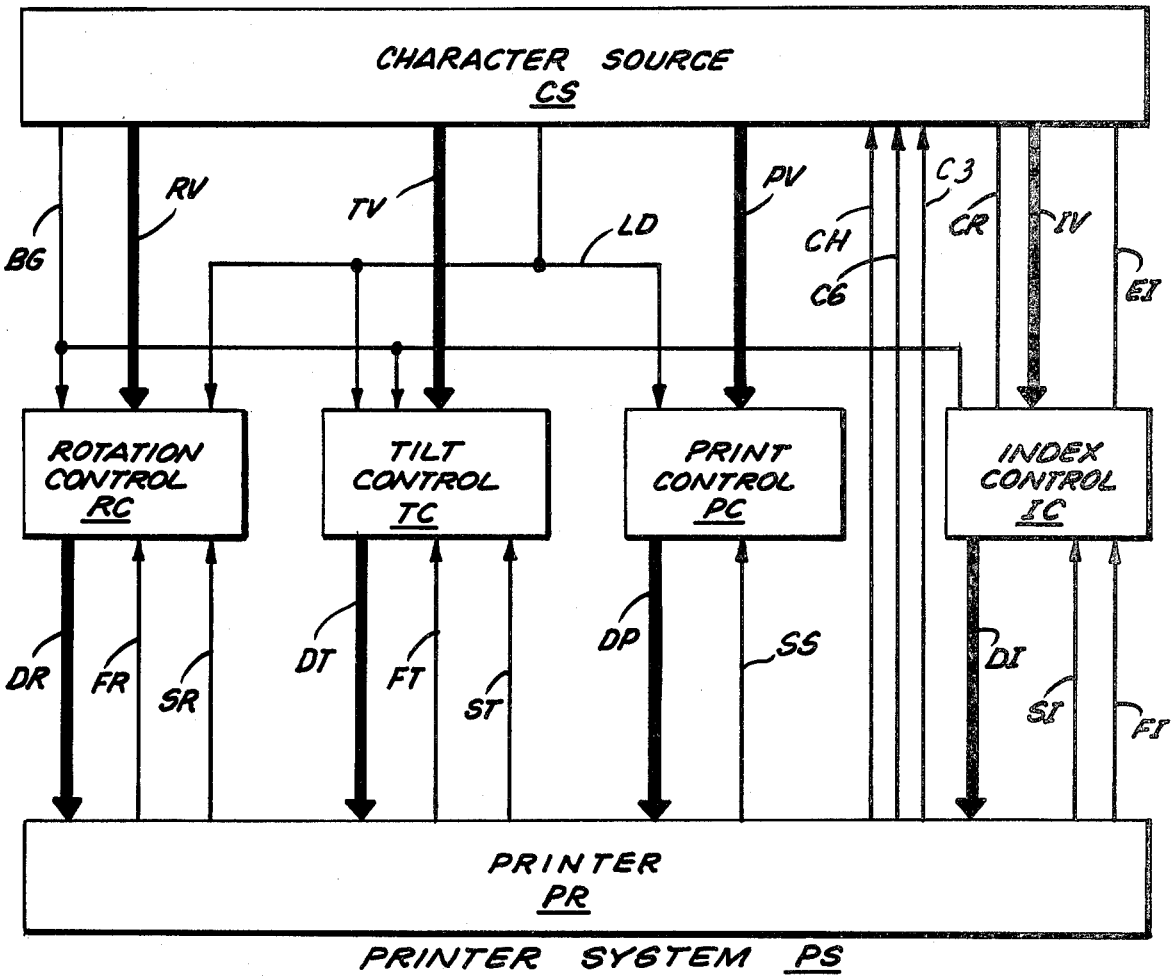
FIG. 1 shows a block diagram of a printer system in accordance with the invention.

The printer system in accordance with the invention as shown in FIG. 1 includes a printer PR which is connected to character source CS via rotation control unit RC, tilt control TC, print shaft control PC and index control IC. The printer PR hereinafter more fully described, includes a print head having a print element upon the partially spherical surface on which are disposed, by way of example, four rows of twentytwo or twenty-four type characters. At any given time one of these type characters occupies a print position, i.e., is directly opposite a platen so that when the print element is driven against a record-medium-carrying platen, the desired character is printed on the record medium. Each type character on the print element can be represented by a two-quantity address relative to this print position or another fixed position. In particular, each type of character is given an address having a first part indicating the row containing the character and a second part indicating its position within the row. The print element is connected via a shaft to a bidirectional motor (such as but not necessarily a step motor) which rotates the print element to present different type characters within a row for printing when receiving signals via cable DR from rotation control RC. In addition, coupled to the shaft is a transducer which emits a pulse on line SR for each character increment of rotation of the shaft. A second transducer on the shaft emits a single pulse (fiducial) of line FR when the shaft has a specific angular position, i.e. the fiducial point or home position. The print element is also connected via a linkage to another motor of the same type as mentioned above which rotates when receiving signals on line DT from tilt control TC to tilt the element for making available different rows of type characters for printing. Similarly, this motor is connected to transducers which emit pulses on lines FT and ST representing respectively the fiducial position and each row increment of tilt.

The print element is carried on a print head including a rocker which is driven toward the platen to print the character of the print element at the print position. This is accomplished by mechanisms driven during each revolution of a D.C. motor in response to the signal on line DP from print control PC. The amplitude of the signal on line DP determines how fast the motor rotates. Connected to the shaft of this motor (print shaft) are transducers which generate a single pulse on each of the lines CH, C3, and C6 during different angular positions of the shaft. During each rotation, a pulse on line C3 occurs when actual driving of the print head begins, a pulse on line C6 occurs after the actual driving has ended, and a pulse on line CH occurs at the "end" of each revolution. In addition, operatively coupled to the shaft is a tachometer which generates a signal on line SS whose amplitude is proportional to the instantaneous rotational velocity of the shaft.

The print head is supported on a print carrier which is driven laterally parallel to the platen to position the print head sequentially opposite different portions of the record medium (i.e. horizontal indexing or escaping and hereinafter called indexing) so that a line of characters can be printed. The indexing is performed by mechanisms driven by a bidirectional motor (for example but not necessarily, a step motor) in response to signals on cable DI from index control IC. Fixed to the shaft of this motor is a transducer which emits a pulse on line SI for each index increment the shaft has rotated. There is a transducer adjacent to the path of travel of the carrier to indicate when the carrier is at a left margin position by emitting a single fiducial pulse on line FI.

The character source CS hereinafter described in detail includes a character code generator which generates coded combinations of bits representing characters and also generates a "sprocket" pulse indicating a character code is available. There are two types of characters generated. The first type are the alpha-numerics and symbols which must be printed and the second type control movement of the carrier, i.e., space, backspace, tab and carrier return. The source CS includes means for detecting the second type of characters and transmitting unique signals representing these characters. For example, when the character is a carrier return a signal is fed respectively on line CR to index control IC. For each of the printable characters source CS divides the character code into: a first binary number which is fed bits-in-parallel, on cable RV to rotation control RC, this number representing the rotational or column address of the character on the print shell; a second binary number which is fed, bits-in-parallel, on cable TV to tilt control TC, this number representing the row address of the character on the print shell; a third binary number which is fed, bits-in-parallel, via cable PV to print shaft control PC, this number representing the required speed of rotation of the print shaft character; and a fourth binary number which is fed, bits-in-parallel, via cable IV to index control IC, this number represents how many index increments should be performed for the character to permit proportional spacing.

The rotational control RC in general comprises: an absolute position counter which registers as binary number the instantaneous rotational position of the print shell and is unit incremented or decremented in response to pulses on line SR in accordance with the direction of rotation of the shell and is cleared to a home value upon receipt of the fiducial pulse on line FR; a desired position register which receives information from lines RV and stores the rotational position or address of the desired character and a comparator means which compares the numbers stored in the counter and register to stop the rotation when the numbers are equal, and to transmit directional drive signals on cable DR to printer PR.

Tilt control TC is generally the same as rotational control RC and receives its desired address from cable TV, its fiducial pulse from line FT and its incrementing or decrementing pulses from line ST while transmitting its directional drive signals on cable DT.

The index control IC generally comprises: an absolute position counter which registers as a binary number the instantaneous lateral position of the carrier which is unit changed in response to pulses on line SI in accordance with the direction of movement of the carrier; a next position register which is an accumulator register for storing a binary number which gets changed by an amount indicated by the number on line IV: and a comparator means which compares the numbers stored in the counter and register to transmit directional drive signals on cable DI to printer PR. For non printed characters such as carrier return, the indexing starts under the control of the receipt of signals on line CR. At the end of the carrier return and the like operations index control emits a signal on line EI.

It should be noted that since the rotation, tilt and index controls form no part of the invention, they will not be described in detail.

The print control PC hereinafter more fully described in detail is basically a digital-to-analog converter, and a servo-system driving a DC motor.

Each coded combination of bits received from character source CS is connected to a DC voltage which is fed to a drive motor in the printer PR. During each rotation of the drive shaft in the printer PR between the time from the signal on line C6 to the signal on line C3 the drive motor is driven to rotate at a speed required for desired impact of the print element in accordance with the character to be printed. During the remainder of the cycle the motor is driven to rotate at a speed which is a function of the character just printed and the next character to be printed so that the longest one of the tilt, rotate and index operations for this next character ends just as the shaft is in position without waiting to print this next character.

Figure 9:
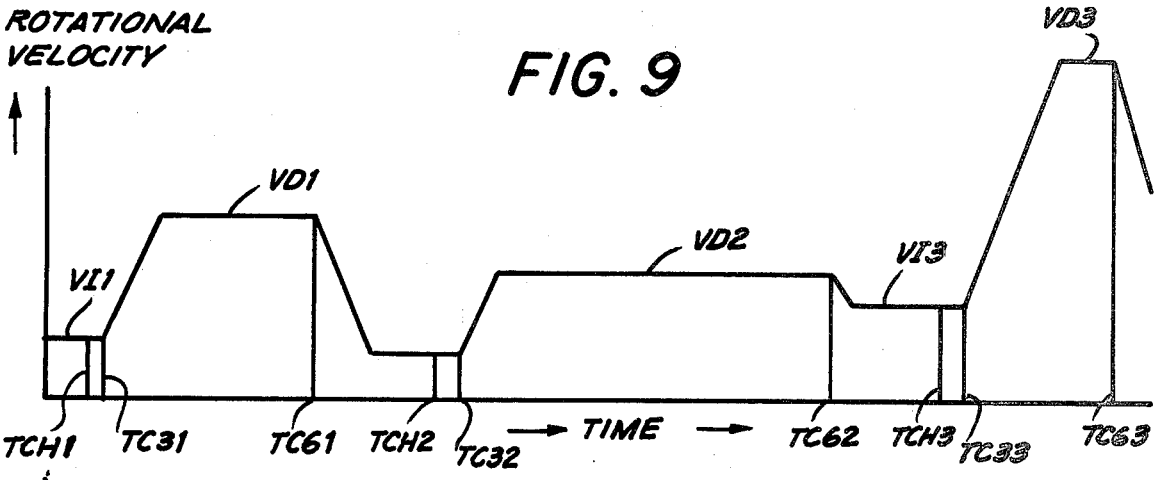
FIG. 9 are waveforms used to describe the operation of the system.

The operation of the printer system PS as shown in FIG. 1 with the aid of the timing diagram of FIG. 9 will be described for general operation realizing that the rotation control RC, tilt control TC and index control IC are initialized and their counters phased with their associated motors by a signal on line BG from character source CS. The basic timing for the system is controlled by rotation of the print shaft of the printer PR whose transducer sequentially and repetitively generates signals on lines CH, C3 and C6. In general at a time TCHN (N=1, 2, 3, . . . ) a signal on line CH from printer PR to character source CS calls for a new character. Then at a time TC3N (N=1, 2, 3, . . . ) a signal on line C3 from the printer PR causes source CS to emit the tilt, rotate and index numbers, respectively on lines TV, RV and IV to the tilt control TC, the rotation control RC and the index control IV. The controls now initiate tilting rotating and indexing by sending signals via lines DT, DR and DI to printer PR. At the same time these numbers are compared in the character source CS with the same numbers for the character that was just printed to determine at what speed the print control PC will drive the print shaft such that the new character is printed just when print head has reached the new index position and the print element is at the tilt and rotate positions which place this new character in the print position. In effect, as will hereinafter become apparent a signal is generated on line DP whose amplitude is a function of the time it will take for the longest of the three movements (tilt, rotate, index to be performed). This signal then drives the print shaft so that the rocker begins moving when the print head and print element arrive at the desired positions. Just before this instant at time TC6N (N=1, 2, 3, . . . ) printer PR emits a signal on line C6 which causes character source CS to change the number being fed to print control PC. This new number is associated with the size of the character to be printed and in effect controls the impact speed. Print control PC in response to this signal transmits a signal on line DP to the printer PR so that the shaft now decelerates to a velocity such that the rocker is thrown forward with a velocity to accomplish the desired impact force. Then the process repeats itself for the next character. Thus it is seen from FIG. 9, that the shaft switches between to velocity levels, one which is related to the impact required for the character to be printed, i.e., velocities VI1, VI2, VI3, . . . for three successive characters, and the other which is related to the time required to move the print head and element between successive characters, i.e., the velocities VD1, VD2, VD3, . . . .

For control characters like carrier return and others taking a long time to accomplish, as will hereinafter become apparent, the print shaft stops just after the printer PR emits a signal on line CH so that the rocker is not thrown until a character is to be printed. In effect no signal is emitted on line DP so the shaft is not rotated. At the end of the carrier return operations the index control IC emits a signal on line EI which character source CS responds to as if it were a signal on line CH.

Figure 2:
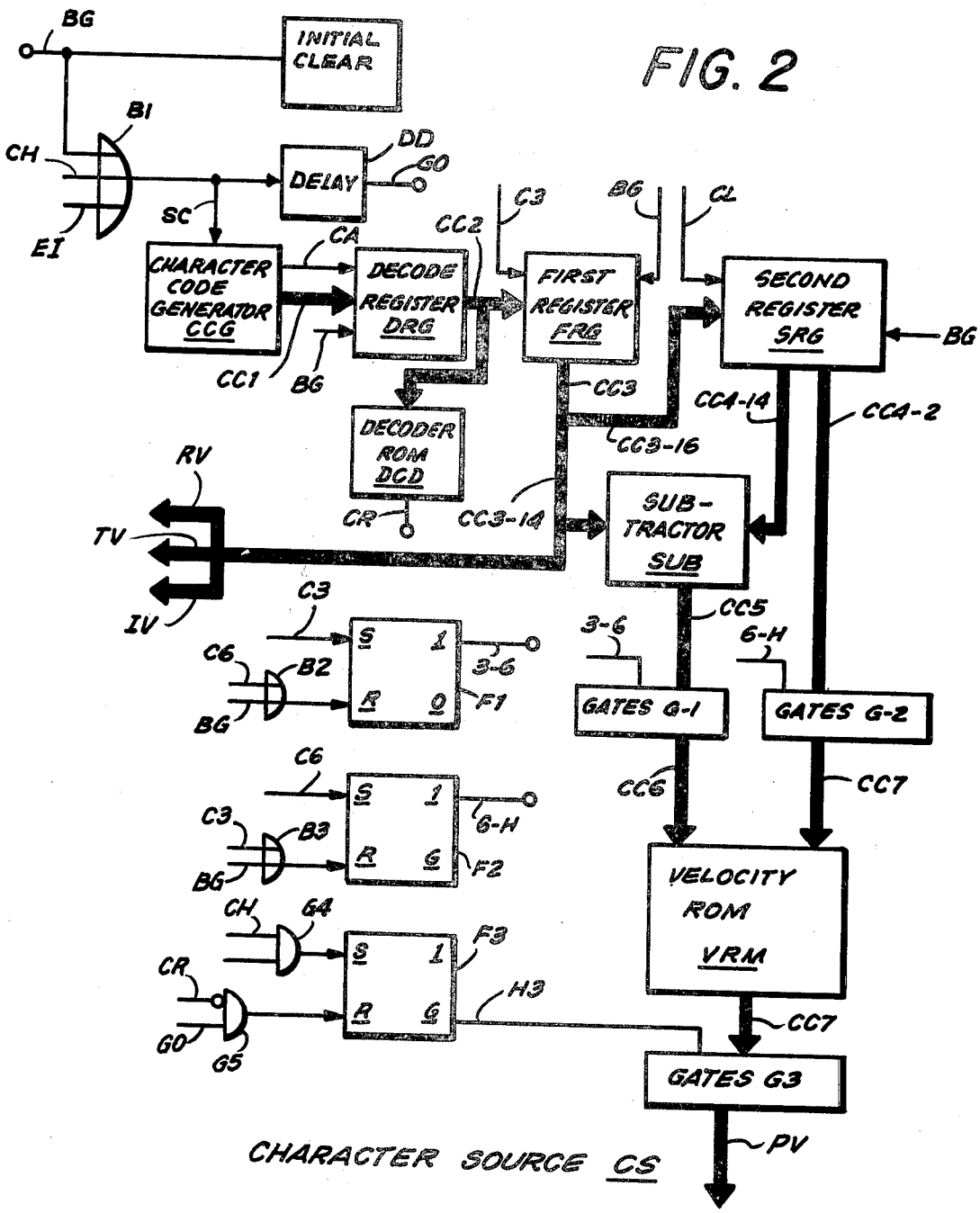
FIG. 2 is a logic diagram of the character source of FIG. 1.

The character source CS shown in FIG. 2 centers around character code generator CCG which is connected by multiline cable CC1 to decode register DRG. Character code generator CCG can take on many forms such as a keyboard, a computer, a miniprocessor, a modem, a teletypewriter, a magnet tape, disc, card or drum memory, etc. Its requirement is that it present the coded representation of one character each time it receives a pulse from line SC. Preferably, the character codes are presented bits in parallel onto cable CC1. For example, if the code being used represents tilt, rotate, index and impact value of two, six, six and two bits respectively then these sixteen bits are presented simultaneously on sixteen parallel lines of cable CC1. After each character code is so presented code generator CCG emits a character available pulse on line CA.

One character code is emitted onto the lines of cable CC1, each time a pulse is present on line SC connected to the output of three-input OR-circuit B1. At the start of operations the initial clear device IC emits a pulse of line BG which is connected to an input of OR-circuit B1. During normal operations pulses on line CH connected to another input of the OR-circuit B1 call for the characters. At the end of a carrier return a signal on line EI, connected to the third input of the OR-circuit, from the index control IC calls for the next character by emitting a pulse of line SC. It should be noted that the line SC is connected to the input of a delay device DD, such as a one-shot circuit whose output emits a pulse of line GO a given time after receipt of a pulse at its input.

Decode register DRG can be a sixteen-stage flip-flop register wherein each flip-flop has an information input connected to one of the lines of cable CC1 and a gating input connected to line CA. The output of each flip-flop is connected to a line of cable CC2. The lines of cable CC2 are connected to a decoder ROM DCD which decodes the character codes for unique characters such as a carrier return. If the code for carrier return is present then the decoder ROM DC emits a signal on line CR. The cable CC2 is connected to first register FRG which can be the same as decode register DRG. Note that the line C3 is connected to the gating inputs.

The outputs of the first register FRG are connected to the sixteen lines of cable CC3. All sixteen lines of cable CC3 are connected via cable CC3-16 to second register SRG which is similar to the other two registers, however, with line C6 connected to the gating inputs. The two lines of cable CC3 which carry the two bits of the tilt number became cable TV, the six lines of the cable which carry the six bits of the rotate number become cable RV and the six lines of the cable which carry the six bits of the index number become cable IV.

These fourteen lines of CC3-14 (without the two lines carry the impact number) are fed to the minuend inputs of a fourteen-bit parallel subtractor SUB, while the same fourteen lines of cable CC4-14 connected to the outputs of fourteen of the flip-flops of the register SRG are connected to the subtrahend inputs of subtractor SUB. The output of the subtractor SUB will be a fourteen bit number plus a sign bit connected via fifteen-line cable CC6 to inputs of velocity ROM VRM.

The outputs of the two flip-flops of register SRG which store the impact number are connected to gates G2 which can be two two-input AND-circuits each have one input connected to one of the lines of the cable and another input to the line 6-H. The outputs of gates G2 are connected via two-line cable CC7 to inputs of the velocity ROM.

The velocity ROM VRM can be a read only memory having a plurality of addressed registers. Each register stores a number related to a particular shaft velocity. The memory can be divided into two fields. The first field is addressed by the signals on cable CC7. It will be assumed that there can be up to four impact velocities. Therefore each one of four registers of the memory will store an impact velocity number related to an impact velocity. The coded combinations of bits on the two lines of the cable CC7 can select each of these registers.

The same principle prevails for the intercharacter velocity numbers. In this case there are sufficient registers in a second field of the memory to store velocity numbers for all combinations of two successive characters. These registers are selected by signals on lines CC6. In either case the velocity numbers are emitted on lines of cable CC7 to gates G3 which are again a parallel array of two-input AND-circuits with one input connected to one of the lines of the cable CC7 and a second input connected to line H-3. The outputs of the gates G3 are connected to lines of cable PV.

The remainder of the character source CS is the trailing-edge triggered set-reset flip-flops F1, F2 and F3 whose function is to divide each print shaft cycle into different operating segments.

The operation of the character source CS will now be described. When the initial clear unit IC emits a pulse on line BG it clears the flip-flops F1 and F2, all the registers and calls for the first character by a signal on line SC. The character is fed from character source CS to register DRG. It will be assumed the character is not a carrier return or the like. Shortly thereafter delay DD emits a pulse on line GO which reacts flip-flop F3 opening gates G3. Since gates G1 and G2 are closed a zero address is fed to the velocity ROM. In the zero address register is a number which causes the print shaft to rotate at some velocity. When the shaft reaches a certain position printer PR emits a pulse on line C3. This pulse sets flip-flop F1 and opens register FRG which receives the first character. Register FRG transmits the tilt, rotate and index numbers to cables TV, RV and IV, respectively, and the print head and element start moving to the desired character position. At the same time the character code is fed to the minuend input of the subtractor while the subtrahend input receives a number equal to all zeroes, i.e., the home position of the print head and element. The subtrahend emits a remainder number which is fed via gates G1 to the velocity ROM. The address selected therein emits an intercharacter velocity number which is fed via cable CC7 and gates G3 to cable PV. The shaft is now accelerated to the intercharacter velocity and sometime thereafter a pulse is received on line C6. This pulse restores flip-flop F1 closing gates G1, sets flip-flop F2 opening gates G2 and opens second register SRG which receives the character in first register FRG. The impact velocity number is fed from register FRG via cable CC4-2, gates G2, and cable CC7 to velocity ROM VRM. The contents of the register associated with that velocity number are fed via cable CC7 and gates G3 to cable PV. The shaft now decelerates the desired impact velocity. Sometime after impact, printer PR emits a pulse on line CH. This pulse passes through OR-circuit B1 to line SC calling for the second character which is loaded as previously described. The pulse on line CH is fed to AND-circuit G4. This pulse has a duration such that it will be present long enough to gate a signal on line CR from decoder ROM DCD if the character being loaded into decoder register DRG (the second character) is a carrier return. It is assumed that the second character is not a carrier return, therefore flip-flop F3 is not set and gates G3 remain open so that the print shaft keeps rotating. Sometime therafter a pulse is present on line C3 and the cycle continues as above with the subtraction being performed between the character codes in registers FRG and SRG to determine intercharacter velocity, etc.

Whenever a carrier return is decoded, the pulse on line CH gates the signal on line CR at AND-circuit G4 setting flip-flop F3 which blocks gates G3 and the shaft stops since no velocity number is present on lines PV. The CR signal at an inhibiting input of AND-circuit G5 prevents to signal on line GO from resetting the flip-flop F3. When the carrier return operation is finished a signal is fed via line EI through OR-circuit B1 to call for the next character and the operation proceeds as described above. If this character is not a carrier return there is no signal on line CR so that when delay device DD emits a signal onto line GO it resets flip-flop F3 via AND-circuit G5.

Note although the velocity ROM stored all possible intercharacter velocity numbers, the system can be implemented differently. One could determine by comparisons which of the three operations (tilt, rotate or index) took the longest time and then using this value as an address search in a smaller ROM for the desired velocity value.

Figure 3:
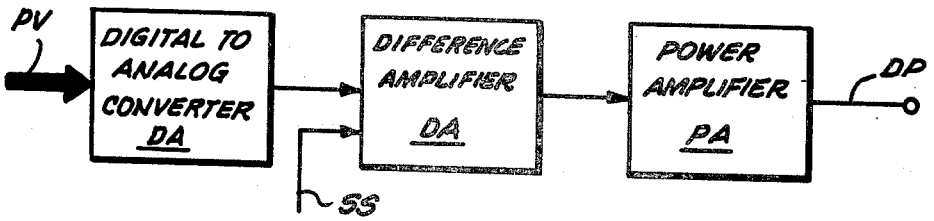
FIG. 3 is a logic diagram of the print control of FIG. 1.

The print control PC shown in FIG. 3 is basically a servo system wherein the print velocity number on the lines of cable PV is converted in digital-to-analog converter DA to a signal whose amplitude represents the desired shaft velocity. This signal is fed to one input of difference amplifier OA. A signal on line SS connected to a tachometer on the shaft has an amplitude which represents the actual shaft velocity. This signal is fed to the other input of the amplifier OA. Difference amplifier OA transmits the difference or error signal to the power amplifier PA whose output is connected to line DP.

The printer PR is shown in FIGS. 4 to 8. A print carrier assembly 20 is trunnioned at a pair of rollers 22 straddling a traverse rod 24 fixed in frame 14 and pairs of rollers 26 straddling a traverse rod 28 also fixed in frame 14.

Carrier 20, comprising a ribbon-feed 30, a print head 32 and a D.C. motor 50, is stepped via a cable means 34, by a step motor 36. A transducer 38, on motor 36 relays information to index control IC of FIG. 1.

In particular, when step motor 26 receives the stepping signals on cable DI from index control IC, the motor rotates pulley 34A causing the cable means 34 to move the carrier 20 to the left or right. At the same time, transducer 38 which can comprise a disc 38A with a band of slots, and a light source-light sensitive cell, such as a light emitting diode-photosensitive solid state device straddling the band indicated generally as combination 38B, emits a pulse on line SI each time a slot of disc 38A is operatively opposite combination 38B. In addition, carrier 20 carries a light interposer 39A which interrupts a light path established between a light source and a light sensitive cell indicated generally at 39B to cause the transmission of a pulse on line FI to index control IC when the print carrier 20 is at the left hand margin. (This signal can be used for carrier return complete signal.)

Figure 4:
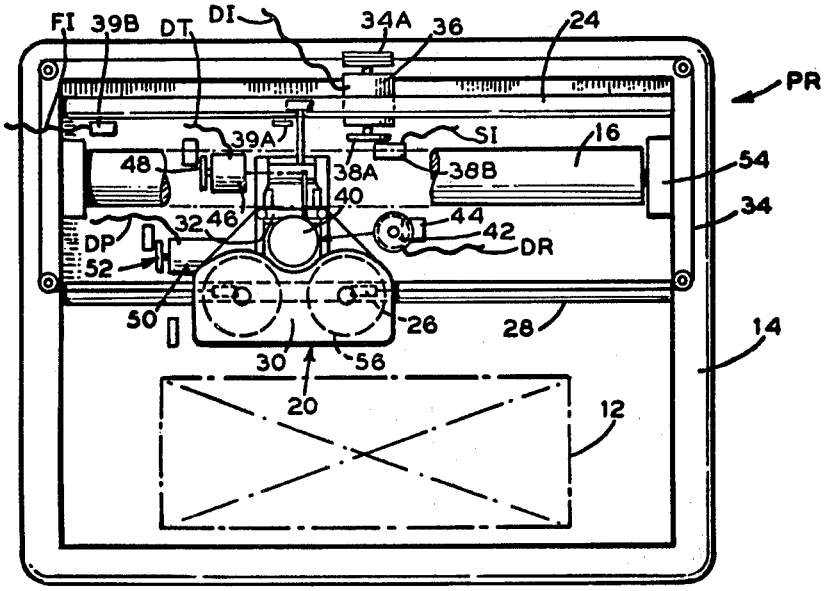
FIG. 4 is a plan view of the printer of FIG. 1, the view omitting unrelated parts and being partially diagrammatic.

The print head has rotate step motor 42 which rotates in a clockwise or counter-clockwise direction as viewed in FIG. 4 in response to step signals received on cable DR from the rotation control RC of FIG. 1. Connected to the shaft of motor 42 is a slotted disc having one band of twenty-two equispaced slots (one for each character in a row) and a second band with a single slot. Each of the bands is straddled by light source-light sensitive cell combinations indicated generally by box 44. Thus as the motor 42 is stepped a pulse is emitted on line SR as each of the slots of the first band is sensed. In addition, whenever the slot of the second band is sensed a pulse is emitted on line FR to rotation control RC of FIG. 1. The details of how step motor 42 rotates print head 40 will be described hereinafter in detail.

A tilt step motor 46 rotates clockwise or counter-clockwise in response to step signals received on cable DT from tilt control TC of FIG. 1. Connected to the shaft of motor 46 is a slotted disc having one band with four slots one for each row of characters and a second band with a single slot, each of the bands is straddled by a light source-light sensitive cell combination indicated generally by box 48. Thus as the motor 46 is stepped a pulse is emitted on line ST as each slot of the first band is sensed, and whenever the slot of the second band is sensed a pulse is emitted on line FT to tilt control TC of FIG. 1.

Shaft 18 is driven by D.C. motor 50 in response to signals received on cable DP from print control PC, the amplitude of the signal determining the rotational velocity of the shaft. Connected to the shaft of motor 50 is a disc having three slots, each in different bands, straddling each band is a light source, light sensitive cell combination indicated generally by box 52. Thus, as the motor 50 is rotated a pulse is emitted sequentially on lines CH, C3 and C6. The positions of the slots associated with line C3 are chosen to indicate when the actual printing is to start as will hereinafter become apparent.

In addition, a tachometer 53 is operatively connected to shaft 18 to give a voltage on line SS whose amplitude is an indication of the instantaneous velocity of the shaft.

The platen-rotation means 54 and ribbon-feed means 56, although linked operatively through manual, mechanical and logic control, are not a part of the invention, and therefore are referenced for edification only.

Figure 5:
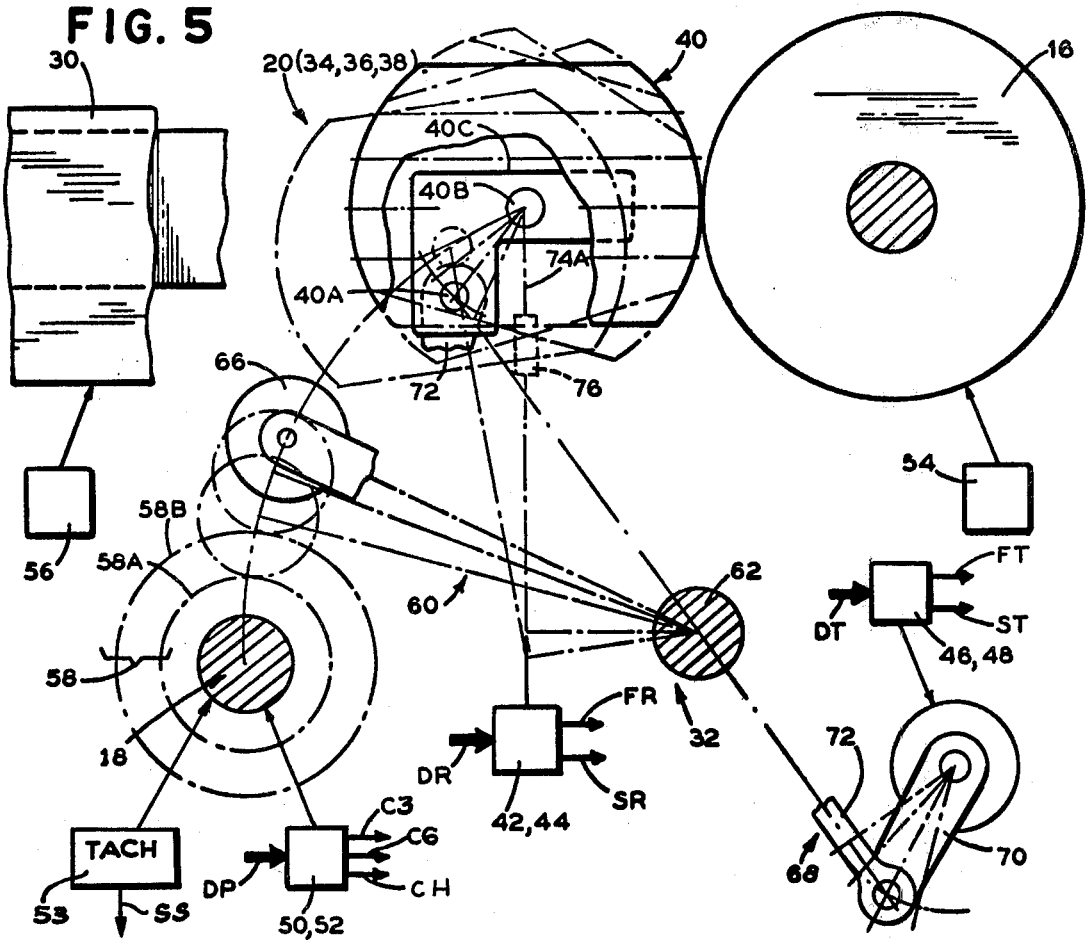
FIG. 5 is a diagrammatic side view of the printer of FIG. 4 showing cooperating elements and their logic-controlled energizing means.

The basic operations and logic references shown in FIG. 5 center around velocity-controlled cam 58 which cooperates with follower 66 to impel the rocker assembly 60 of print head 32 clockwise around bearing 62 driving the print element 40 toward platen 16. Cam 58 is fixed on shaft 18 which is spindled on carrier 20. Shaft 18 is rotated by D.C. motor 50 which is mounted on carrier 20. In fact, shaft 18 can be the shaft of motor 50. In this way, the print head driving mechanism is greatly simplified over previously known driving mechanisms. (Two additional cams, described hereinafter, are also mounted on shaft 18.)

Figure 6:
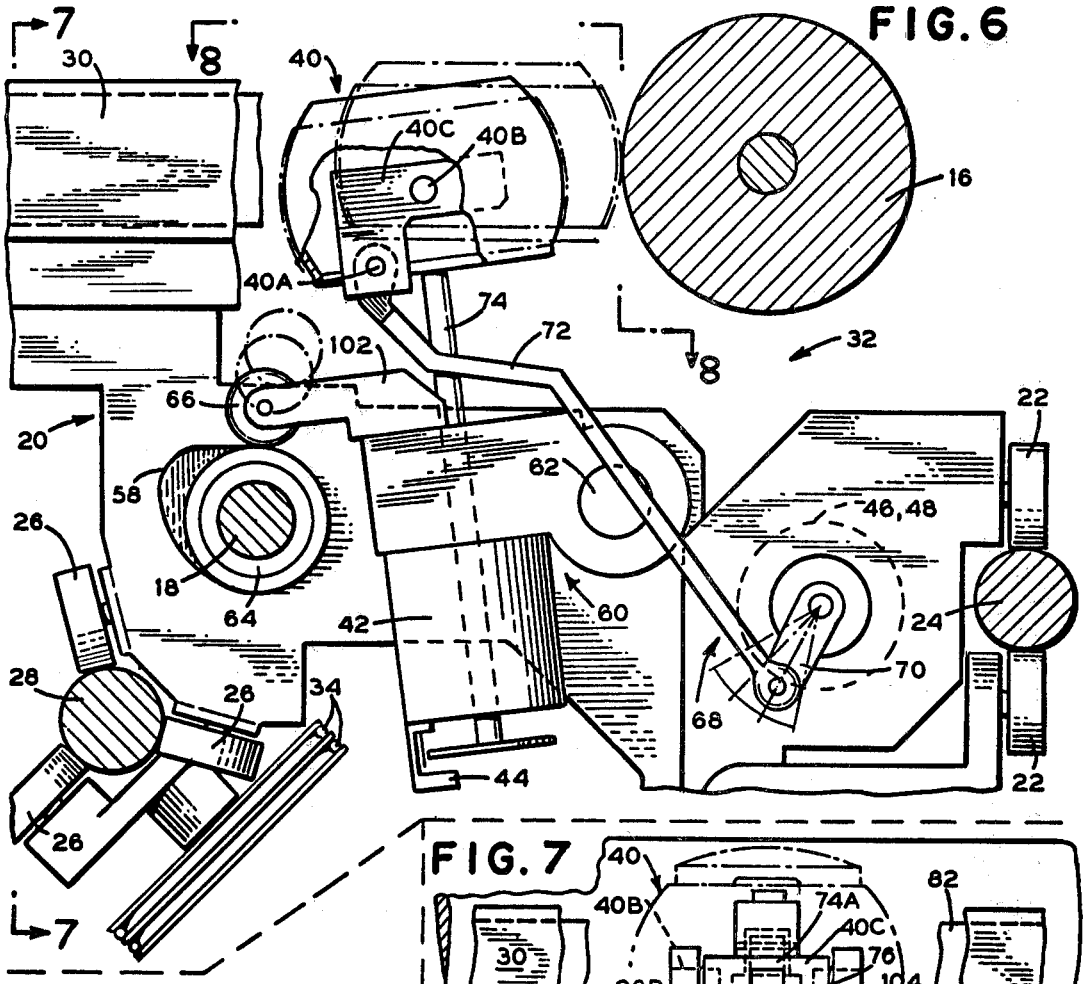
FIG. 6 is a view similar to FIG. 5 except that structure is clarified, energizing means are omitted or shown schematically and the print head or rocker assembly is retracted.
Figure 7:
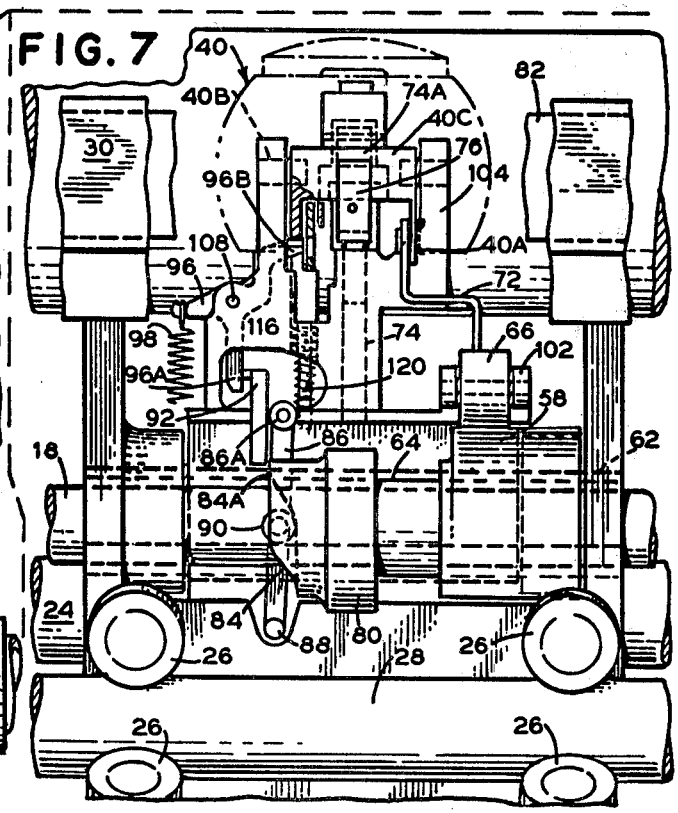
FIG. 7 is a front view taken on line 7—7 in FIG. 6, parts broken away or are phantom outline and similar except that the rocker assembly is in the print position.
Figure 8:
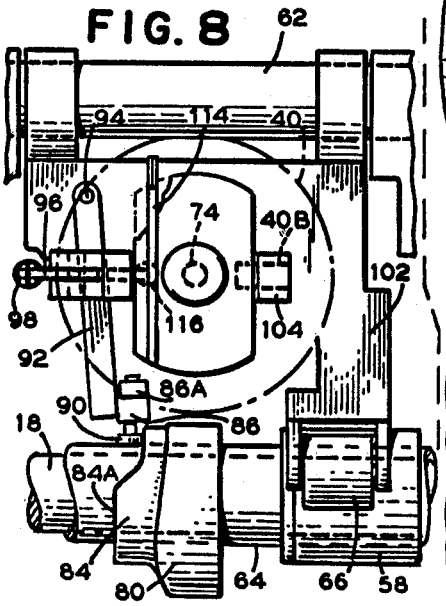
FIG. 8 is a fragmentary plan view taken on the line 8—8 in FIG. 6.

As best seen in FIGS. 6, 7, and 8, the print head 32 comprises the rocker assembly 60 and the tilt means 68.

The rocker assembly includes pivotable base member 60, mounted for rotation about bearing 62. The member 60 has a yoke 104 and an arm 102 which carries cam follower 66. Yoke 104 spindles print element 40 at bearings 40B, spindles shaft 74 in a bearing, and arm 96 in a bearing 108.

Passing through the base of rocker 60 is shaft 74 of motor 42 having one end connected to universal joint 76. (See particularly FIG. 7). Above universal joint 76, the upper section 74*a* of shaft 74 is journaled through a housing 40*c*, tiltable on bearings 40*b*, to connection with print shell 40. The other end of shaft 74 is the shaft of motor 42 whose housing is mounted on the rocker. Thus rotation of motor 42 presents the twenty-two different angular positions each associated with a different character in the rows of characters on print shell 40 to platen 16.

The tilt means 68 comprises the motor 46 mounted on carrier 20. The shaft of motor 46 is connected via arm 70 and link 72 to bearing 40*a* in housing 40*c*. By this means, the rotation of motor 46 selects which of the rows of characters on print element 40 is to be presented to platen 16. It should be noted that since link 72 connected between bearing 40*a* and pin 70*a* passes through the pivot point of rocker 60 (i.e. bearing 62) as shown in FIGS. 5 and 6 the differential linkage length is minimized during the pivoting of the rocker assembly 60.

In FIGS. 7 and 8 there is shown on shaft 18 a ribbon feed cam 80 for controlling the ribbon 82. Since the ribbon feed portion of the printer forms no part of the present invention and will not be discussed further.

In addition, shaft 18 has a detent-control cam 84. An arm 86, spindled at a bearing 88, carries a cam follower 90. The outer end of arm 86 spindles a roller 86*a* engaged by a second arm 92 spindled at a bearing 94. Arm 92, in turn, is engaged by a detent arm 96 that is biased counter-clockwise by a first spring 98 and by a second spring. The detent arm 96 engages and disengages tilt and rotate detents during the print operation.

In operation, rotate motor 42 rotates shaft 74 to select the "column" of the desired character on print element 40 while at the same time tilt motor 46 operative via link 72 tilts print element 40 to the row of the desired character. All this time the shaft 18 is rotating and during each revolution three motions are performed as a result of the rotation of cam 58 to drive rocker member 60, a rotation of cam 80 to move ribbon 82 and a rotation of cam 84 to control the detenting of the print element 40.

During the print part of each shaft cycle rocker assembly 60 responds to follower 66 mounted thereon. This response moves print element 40 towards platen 16 in two separate velocity patterns. Follower 66 is first accelerated by the rise in cam 58 from the dwell 58*a* to, substantially, the peak 58*b*, from which point velocity is imparted to the mass of print head 32. In this manner, print shell 40 prints characters at variable impact dependent upon acceleration changes in motor 50. Thereafter the velocity of shaft 18 is determined by the time it will take for the head and print element thereon to be in position for printing the next character.

Finally cam 80 causes the indexing of ribbon 82.

While specific circuits, components and devices have been shown and described it should be realized that they are not unique. For example, the decoders can be decoding matrices, read only memories, programmable read only memories, random access memories, etc. In addition, some of the drive motors were described as step motors. However, these can be any type of servomotor and particularly bidirectionally controlled D.C. motors. The transducers were shown as opto-electrical devices. They could be any shaft position indicating devices using conductive, magnetic, capacitive or other techniques. The tachometer could take on many forms such as a simple generator whose input shaft is connected to the drive shaft 18.

While only one embodiment of the invention has been shown and described in detail there will now be obvious to those skilled in the art many modifications and variations satisfying many or all of the objects of the invention but which do not depart from the spirit thereof.

What is claimed is:

1. A printer comprising a platen, a movable carrier, means for moving said carrier to different index positions opposite said platen, a print head on said movable carrier, said print head having a print element upon which are type characters, said characters being grouped in a plurality of sets according to size, positioning means for selectively moving said print element to position a particular type character operatively opposite said platen for printing, a rocker means for supporting said print element, a cam follower connected to said rocker means, and means for mounting said rocker means to pivot so that said print element can move against said platen, a drive shaft, a cam on said drive shaft and operatively cooperative with said cam follower so that as said drive shaft rotates through a complete rotational cycle said print element is driven toward said platen, a motor means when energized unidirectionally rotating said drive shaft through a complete rotational cycle at selectively different speeds, and control means for energizing said motor means to rotate said drive shaft during a first portion of a rotational cycle at a first speed selected in accordance with the set to which belongs the character to be printed and during a second portion of the same rotational cycle at a different speed selected in accordance with the longer of two periods of time, the first period of time being related to the time required for said carrier to move to the next selected index position and the second period of time being related to the time required for the print element to move to position the next selected character opposite said platen for printing.

2. A printer comprising a platen, a print head, said print head having a print element upon which are type characters, said characters being grouped in a plurality of sets according to size, positioning means for selectively moving said print element to position a particular type character operatively opposite said platen for printing, a rocker means for supporting said print element, a cam follower connected to said rocker means, and means for mounting said rocker means to pivot so that said print element can move against said platen, a drive shaft, a cam on said drive shaft and operatively cooperative with said cam follower so that as said drive shaft rotates through a single rotational cycle said print element is driven toward said platen, a motor means when energized uni-directionally rotating said drive shaft through a single rotational cycle at selectively different speeds, and control means for energizing said motor means to rotate said drive shaft during one portion of each rotational cycle at a first speed in accordance with the character to be printed and the character just printed so that both the time between the printing of successive characters and the accelerations and decelerations of the motor are minimized and during another portion of the same rotational cycle at a different speed selected in accordance with which of the sets of said plurality the character to be printed belongs.

* * * * *